US011189946B2

(12) United States Patent
Rubens et al.

(10) Patent No.: US 11,189,946 B2
(45) Date of Patent: Nov. 30, 2021

(54) COMPACT COMBINATION CONNECTOR

(71) Applicant: FCI CONNECTORS DONGGUAN LTD, Dongguan (CN)

(72) Inventors: Paul Rubens, Allen, TX (US); Justin Chen, Dongguan (CN)

(73) Assignee: FCI CONNECTORS DONGGUAN LTD., Dongguan (CN)

( * ) Notice: Subject to any disclaimer, the term of this patent is extended or adjusted under 35 U.S.C. 154(b) by 16 days.

(21) Appl. No.: 16/625,621

(22) PCT Filed: Jun. 26, 2017

(86) PCT No.: PCT/CN2017/090043

§ 371 (c)(1),
(2) Date: Dec. 20, 2019

(87) PCT Pub. No.: WO2019/000183

PCT Pub. Date: Jan. 3, 2019

(65) Prior Publication Data

US 2021/0159624 A1 May 27, 2021

(51) Int. Cl.
*H01R 13/506* (2006.01)
*H01R 12/73* (2011.01)
(Continued)

(52) U.S. Cl.
CPC ..... *H01R 12/732* (2013.01); *H01R 12/724* (2013.01); *H01R 13/506* (2013.01); *H01R 43/18* (2013.01)

(58) Field of Classification Search
CPC .. H01R 12/732; H01R 12/724; H01R 13/506; H01R 43/18; H01R 13/658; H01R 13/6582; H01R 12/716
See application file for complete search history.

(56) References Cited

U.S. PATENT DOCUMENTS 5,098,315 A * 3/1992 Scowen ..... H01R 13/5221 439/587
5,919,062 A * 7/1999 Wu ..... H01R 13/658 439/607.53
(Continued)

FOREIGN PATENT DOCUMENTS

CN 2358582 Y 1/2000
CN 1474481 A 2/2004
(Continued)

OTHER PUBLICATIONS

International Search Report and Written Opinion for International Application No. PCT/CN2017/090043 dated Mar. 14, 2018.
(Continued)

*Primary Examiner* — Tho D Ta
(74) *Attorney, Agent, or Firm* — Wolf, Greenfield & Sacks, P.C.

(57) ABSTRACT

A compact connector that mates with a complementary connector at high mating force. The connector (100) may have a housing (102) with a member (104) having a plurality of sides (106) and an opening (108) at a first side (110), and a frame (114) mounted to the member (104) from the first side (110) and having a plurality of walls (116) so as to bound the opening (108). The frame (114) may be made of a material that withstands forces to which the connector (100) may be exposed during mating. The member (104) may be made of a less robust material, such as plastic with thin walls (116) so as to enable a compact connector. The frame (114) and the member (104) may have engagement features, including latches, complementary chamfer and bevel features that may aid in mounting the frame (114) to the member (104) and locking features that resist disengagement of the frame (114) and the member (104).

25 Claims, 8 Drawing Sheets

(51) Int. Cl.
*H01R 12/72* (2011.01)
*H01R 43/18* (2006.01)

(56) References Cited

U.S. PATENT DOCUMENTS

| | | | | |
|---|---|---|---|---|
| 6,007,379 | A * | 12/1999 | Michaelis | H01R 13/6594 439/607.04 |
| 6,193,550 | B1 * | 2/2001 | Yamashita | H01R 13/514 439/594 |
| 8,435,075 | B2 * | 5/2013 | Lim | H01R 12/724 439/607.35 |
| 2009/0114439 | A1 | 5/2009 | Su et al. | |
| 2010/0255727 | A1 * | 10/2010 | He | H01R 13/6582 439/607.3 |
| 2012/0040552 | A1 | 2/2012 | Wu | |

FOREIGN PATENT DOCUMENTS

| | | | |
|---|---|---|---|
| CN | 2636448 | Y | 8/2004 |
| CN | 1739223 | A | 2/2006 |
| CN | 201181760 | Y | 1/2009 |
| CN | 201562801 | U | 8/2010 |
| CN | 201829698 | U | 5/2011 |
| CN | 102185196 | A | 9/2011 |
| CN | 102204017 | A | 9/2011 |
| CN | 102377060 | A | 3/2012 |
| CN | 202183503 | U | 4/2012 |
| CN | 202737156 | U | 2/2013 |
| CN | 105284009 | A | 1/2016 |
| CN | 106785542 | A | 5/2017 |
| JP | 2009-123450 | A | 6/2009 |
| WO | WO 2004/112199 | A1 | 12/2004 |

OTHER PUBLICATIONS

International Preliminary Report on Patentability for International Application No. PCT/CN2017/090043 dated Jan. 9, 2020.
Chinese Office Action dated Dec. 9, 2020 in connection with Chinese Application No. 201780094211.8.
Chinese Office Action dated Aug. 23, 2021 in connection with Chinese Application No. 201780094211.8.

* cited by examiner

COMPACT COMBINATION CONNECTOR

CROSS-REFERENCE TO RELATED APPLICATIONS

This application is a 35 U.S.C. § 371 National Phase filing of International Application No. PCT/CN2017/090043, filed on Jun. 26, 2017, entitled "COMPACT COMBINATION CONNECTOR," the entire contents of which is incorporated herein by reference in their entirety.

BACKGROUND

This application relates generally to electrical interconnection systems, such as those including electrical connectors, used to interconnect electronic assemblies.

Electrical connectors are used in many electronic systems. It is generally easier and more cost effective to manufacture a system as separate electronic sub-assemblies, such as printed circuit boards ("PCBs"), which may be joined together with electrical connectors. A known arrangement for joining several PCBs is to have one PCB serve as a backplane. Other PCBs, called "daughterboards" or "daughtercards", may be connected through the backplane.

There are various types of electrical connectors associated with joining multiple sub-assemblies. For example, power connectors transmit electrical energy between interconnected PCBs; signal connectors transmit operating signals between interconnected PCBs. The conductive elements may be shaped and positioned to carry signals or power, with conductive elements configured for carrying power being wider to support higher currents. Signal conductors, in addition to being narrower, may be positioned relative to other signal conductors or wider conductive elements designated for connection to ground so as to provide a desired impedance in the signal conductors. Combo connectors, integrating in one connector both signal and power conductive elements are also known.

BRIEF SUMMARY

Aspects of the present disclosure relate to improved interconnection systems. The inventors have recognized and appreciated techniques for configuring connectors to reduce the size or increase the reliability of a connector. These techniques may be used together, separately, or in any suitable combination.

Accordingly, some embodiments relate to a connector, comprising a housing and a plurality of conductive elements held by the housing, each of the plurality of conductive elements having a mating end, a mounting end opposite the mating end, and an intermediate portion that extends between the mating end and the mounting end. The housing may have a member having a plurality of sides and a first opening at a first side. The mating ends of the plurality of conductive elements may be exposed within the first opening. The first opening may have a first section and a second section separated by a portion of the member. The housing may further include a frame mounted to the member at the first side. The frame may have a plurality of walls defining a second opening. The second opening may be aligned with the first opening.

In some embodiments, an electronic assembly may be provided. The electronic assembly may comprise a first printed circuit board and a first connector mounted to the first printed circuit board. The first connector may comprise a housing and a plurality of conductive elements held by the housing, each of the plurality of conductive elements comprising a mating end, a mounting end opposite the mating end, and an intermediate portion that extends between the mating end and the mounting end. The housing may have a member having a plurality of sides and at least one opening at a first side. The at least one opening may be bounded by a perimeter. The housing may further include a frame having a plurality of walls. The frame may be mounted to the member with the plurality of walls of the frame aligned with the perimeter of the member. Features of the frame may interlock with features of the member at the perimeter. The mounting ends of the plurality of conductive elements may be electrically connected to the first printed circuit board. The mating ends of the plurality of conductive elements may be exposed within openings of the at least one opening.

In another aspect, embodiments may relate to method of manufacturing a connector comprising a housing comprising a member having a plurality of sides and an opening at a first side. The method may include mounting a metal frame having a plurality of walls to the member from the first side so as to bound the opening. The mounting may comprise moving the frame with respect to the member in a first direction to engage a latch on the frame with a complementary latch on the member, the first direction being perpendicular to the first side, engaging edges of the frame and the member so as to move the frame with respect to the member in a direction parallel to the first side, and further moving the frame with respect to the member in the first direction to engaging a projection in an opening whereby motion of the frame with respect to the member in the direction parallel to the first side is blocked.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
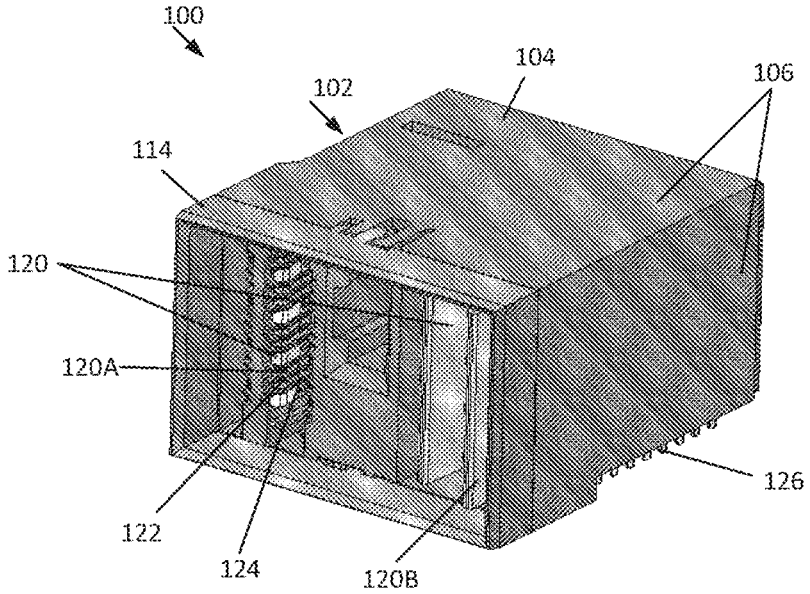
FIG. 1A is a perspective view of a connector, according to some embodiments.
Figure 1B:
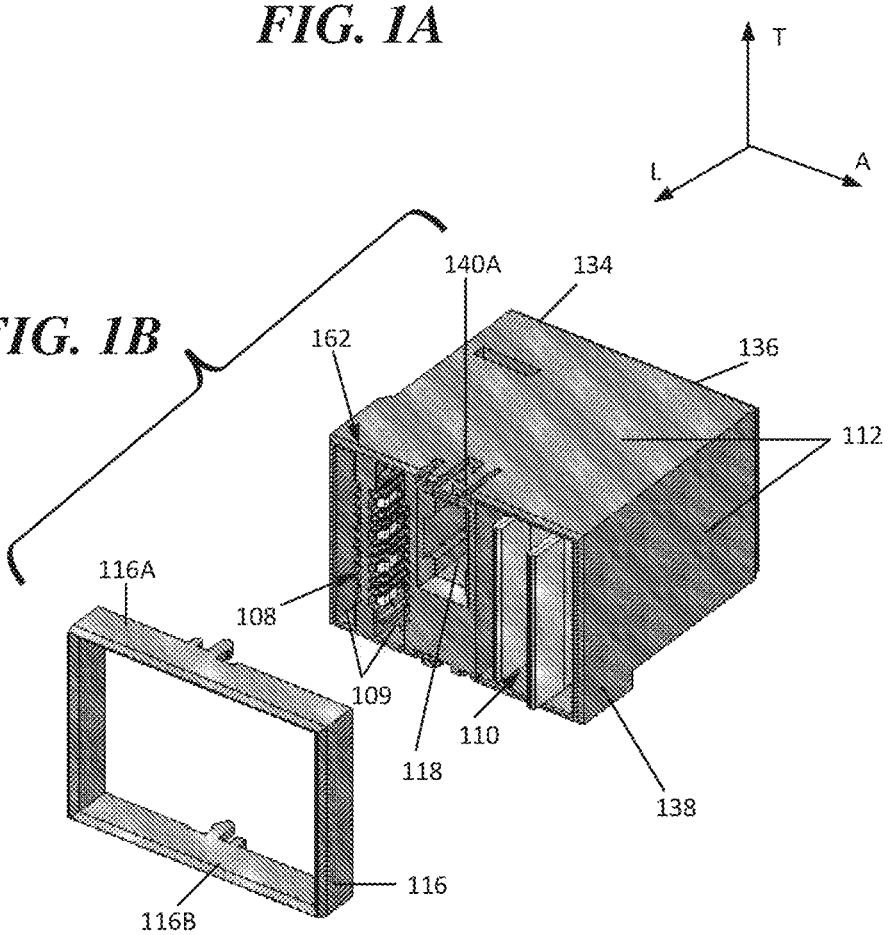
FIG. 1B is a perspective view, partially exploded, of the connector in FIG. 1A.
Figure 1C:
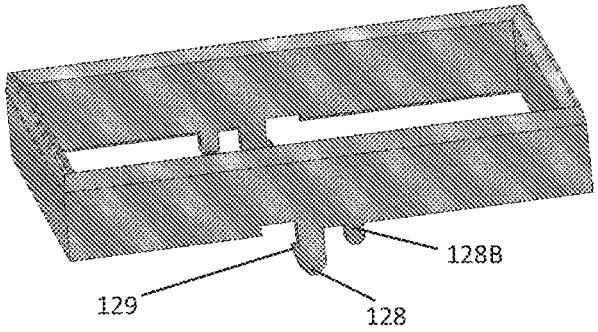
FIG. 1C is an enlarged perspective view of the frame of the connector in FIG. 1A.
Figure 1D:
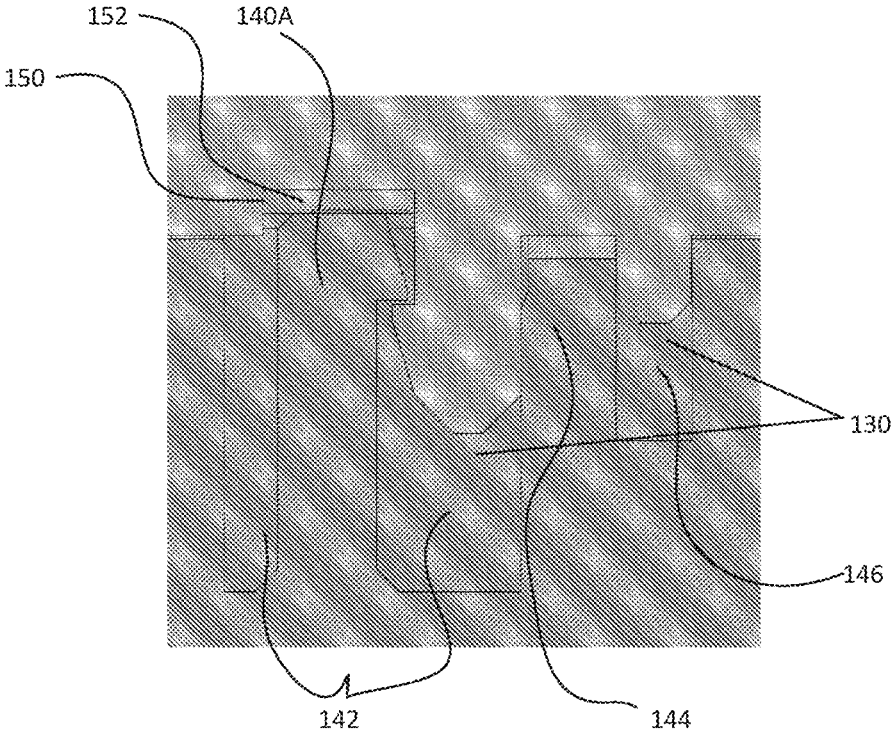
FIG. 1D is an enlarged elevation view of the interlocking features of the connector in FIG. 1A.

The inventors have recognized and appreciated electrical connector designs to support the needs in the electronics industry for electronic systems that are smaller, faster and functionally more complex. The inventors recognized that these market needs might be met by connectors that, though containing multiple conductive elements, are smaller. Reducing the material in the walls of a connector housing, for example, can reduce the size of the connector, enabling smaller electronic systems. However, the inventors also recognized and appreciated that functionally complex systems pack multiple conductive elements into connectors to meet size constraints. A large number of conductive elements require relatively large forces to insert and mate a complementary connector. These forces may be particularly high for a combo connector. The increased insertion and mating forces, alone and in combination with connector housings of reduced thickness, increase the risk that misalignment of connectors during a mating operation will damage the connector housing, which is highly undesirable.

The inventors have recognized and appreciated connector designs that can meet the need for a connector of reduced size without an unacceptable risk of damage.

In accordance with some embodiments, a connector may have a frame mounted to a housing member holding conductive elements. The housing member may be totally or partially insulative and may have relatively thin walls. For example, modern combo connectors of the type described herein may have walls approximately 2 mm thick (e.g., 1.8 mm) surrounding an opening that forms a mating interface. In some embodiments, connectors may have thinner walls (e.g., 1.0 mm or less). These walls may establish a perimeter around an opening in which mating ends of conductive elements may be exposed to form a mating interface. In some embodiments, the opening may be divided into sections. In a combo connector, signal and power conductors may be exposed in different sections.

Regardless of the specific connector configuration, the frame may be aligned with the perimeter of the opening in the housing member. A complimentary connector inserted into the opening, if misaligned during mating, will contact the frame rather than the walls of the housing member. The frame may be made of a material that is more robust than the thinned walls of the housing member. As a specific example, the housing member may be made of plastic walls not thicker than 1.0 mm. The frame, for example, may be made of die cast metal.

The frame may be secured to the housing member using features on the frame and the housing member that engage. In some embodiments, the engagement features may include locking features that resist dis-engagement of the frame and housing member in use. In some embodiments, the frame and the housing member, respectively, may have latch and latch receiving features to provide enough retention force to avoid accidental frame detachments. The latch and latch receiving features optionally may include locks that prevent unlatching. Alternatively or additionally, the engagement features on the frame and the housing member may include ribs with dovetail-shaped cross-sections on one of the components and matching slots to receive the ribs on the other component. In some embodiments, the engagement features, once engaged, may block lateral movement of the frame with respect to the member in directions perpendicular to the mounting direction.

In some embodiments, the frame and the housing member alternatively or additionally may have complimentary chamfer and bevel features at the mounting interface. Engaging the chamfer and bevel features may aid in mounting the frame to the housing member. Further, these features may facilitate mounting of the frame, as they will convert a force in the mounting direction, urging the frame and housing member together, into a lateral force that aligns the frame and the opening in the mounting member such that the latching features are aligned and engage.

Such a construction technique may be used with connectors that have high insertion forces. Accordingly, in some embodiments, the connectors may have other mating elements instead of or in addition to signal conductors and/or ground conductors, as such additional mating elements may increase the insertion force. As an example, the connectors may have guidance members configured to engage complementary guidance members of complementary connectors so as to align the connectors with the complementary connectors. The guidance members optionally may be configured to polarize the connectors such that two complementary connectors can only fit in one way. The guidance member may be unitarily molded with the housing member. Alternatively, the guidance member may be separately formed and mounted to a printed circuit board adjacent to the housing member. Additionally or alternatively, the guidance member may be unitarily molded with the frame.

The techniques may be applied to connectors of any suitable style, including combo connectors. The housing members of combo connectors may hold signal conductive elements on one side and power conductive elements on the other side. In some embodiments, the housing members may have dedicated sections to hold the signal and power conductive elements respectively. The dedicated sections may be connected by the guidance member. The dedicated sections may have different depth along the mounting direction, for example, the power section may have a smaller depth than the signal section. In some embodiments, the mating ends of the conductive elements at the power section are longer than the mating ends of the conductive elements at the signal section in order to hot mate with a complementary connector. Correspondingly, the frame may have larger depth at the power side than the signal side so as to add strength to the housing member. Alternatively, the depth of the signal section may be reduced to the same as the power section and the signal side of the frame may be increased correspondingly to add additional support. The guidance member may be positioned between the signal and power sections to balance the mating and/or unmating force. The signal section may have more latching and/or dovetailed rib features to accommodate higher density of signal conductive elements.

FIGS. 1A-1D illustrate a connector 100, according to some embodiments. The connector may include a housing 102 and a plurality of conductive elements 120 held by the housing. Housing 102 may include a member 104 and a frame 114. The member may have a plurality of sides 106 and an opening 108 at a first side 110. The plurality of sides may be formed by a plurality of walls 112. The walls may be insulative, for example, made of plastic. In some embodiments, some or all of the walls may have a thickness less than 1.8 mm, such as, for example, 1.2 mm or 1.0 mm or less. In some embodiments, the walls may have a thickness greater than 0.5 mm. The frame 114 may be conductive and may be made, for example, of metal. In some embodiments, the frame may be made of die-cast metal.

Each of the plurality of conductive elements 120 may have a mating end 122 configured to mate with a complementary connector, a mounting end 126 opposite the mating end and configured for attachment to another electrical device (e.g., a printed circuit board), and an intermediate portion 124 that extends between the mating and mounting end. The mating ends of the plurality of conductive elements may be exposed within the opening 108 of the member. In the illustrated example, the connector is a combo connector having signal conductive elements 120A and power conductive elements 120B. However, it should be appreciated that the connector designs as described herein may be applied to any types of connectors and that the combo connector is provided merely as an example.

The member 104 may have one or more sections, here illustrated by a first section 134 and a second section 136. Each of the first and second sections may hold a different type of conductive elements, such as signal conductive elements and power conductive elements, respectively. The sections may be formed in any suitable way. In some embodiments, the member may include interior walls or other members to divide opening 108 into sections. The member 104 may be bounded by a perimeter 162.

The frame 114 may include a plurality of walls 116 defining an opening 160. The opening 160 may be aligned with the opening 108 of the member 104 such that, when the frame is mounted to the housing member, the plurality of walls 116 of the frame align with the perimeter 162 of the opening 108 of the housing member. To mate a mating connector to connector 100, the mating connector may be inserted into the opening through the frame. The walls of the housing member are protected from damage by frame 114 during the mating process. In the embodiment illustrated, frame 114 may be mounted to member 104 from the first side 110. To mount the frame and the member may be moved towards each other in a mounting direction, which is perpendicular to the first side.

To secure frame 114 in place once mounted, frame 114 and member 104 may have complimentary engagement features. In some embodiments, frame 114 may include a plurality of latches 128A and protrusions 128B to mate with matching latch receivers 130 on the member 104. Latch 128A may be shaped to fit within opening 142 and protrusion 128B may be shaped to fit within opening 146. A complimentary latch 140A may be positioned within opening 142. Wall 144 may separate opening 142 and opening 146. Latch 128A is longer than protrusion 128B. These relative lengths enable latch 128 to enter opening 142 before protrusion 128B enters opening 146.

Latch 128A may have a tip 129, which is hook-shaped in the embodiment illustrated and extends in a direction perpendicular to the mounting direction. In the illustrated embodiment, the frame has a latch extending from a top wall 116A and another latch extending from a bottom wall 116B. The two latches may be aligned in the transverse direction (T), but any suitable number and position of the latches may be used. Each of the latches may have an adjacent shorter protrusion. In the embodiment illustrated, the hook-shaped tips 129 of latches on opposite walls face in opposite directions. The protrusions 128B are on the side of the latch that is opposite the direction in which the hook-shaped tips 129 faces.

To assemble the frame to the housing member, the frame and the member may be brought together. A latch 128A may enter opening 142 in the member, which contains complimentary latch 140A. In this state, the latch 128A may engage with the latch 140A, for example, by hooking their respective tips. Complimentary latch 140A may be flexibly mounted within opening 142. Alternatively or additionally, wall 144 may be flexible, allowing latch 128 to flex. This flexing of complementary latch 140A and/or latch 128A enables the hooked tips of the latches to slide past each other as the frame and member are brought together.

As the frame is brought toward the housing member, protrusion 128B may enter opening 146. In this position, motion of the frame with respect to the member in the direction parallel to the first side 110 is blocked. In embodiments in which wall 144 is flexible, once protrusion 128B enters opening 146, flexing of wall 144 may be restrained. In this configuration, the hook-shaped tips of complementary latch 140A and latch 128A are engaged, holding frame 114 to member 104. Protrusion 128B may thus serve as a locking element to lock the latches in a locked position.

Other locking features alternatively or additionally may be used. In the embodiment illustrated, may contain a recess 152, bounded by walls creating a lip 150. The distal end of complimentary latch 140A may enter recess 152 as frame 114 and member 104 are brought together. Lip 150 may block flexing of complimentary latch 140A, reducing other motions that might disengage the tips of complimentary latch 140A and latch 128A.

To aid in positioning frame 114 and member 104 such that the latching and/or locking features engage and to provide a secure engagement, frame 114 may have beveled walls 150. The opening 108 of the member may be bounded by chamfered walls (illustrated in FIG. 2A). Mounting the frame with the member may include interlocking the beveled walls with the chamfered walls. Additionally, sliding of the chamfered surfaces relative to the beveled surfaces will translate a force, in the mounting direction, to a force in the lateral direction urging the frame and member into alignment.

Construction techniques as described herein may be useful with connectors having relatively high insertion forces, such as combo connectors including sections for signal conductive elements 120A and power conductive elements 120B. However, those techniques may be used with connectors of any suitable style of connector, and such connectors may include sections instead of or in addition to those identified above. For example, connector 100 may include a guidance member 118 configured to engage a complementary guidance member of a complementary connector so as to align the connector with the complementary connector. The guidance member may be positioned between the first section 134 and the second section 136. The complementary connector may extend through the perimeter 162 of the opening 108 to form electrical connections with the mating ends 122 of conductive elements 120 exposed within openings 109 of the opening. The complementary connector may be mounted to a second printed circuit board.

In the illustrated example, the guidance member and the member 104 is a single-piece. A "single-piece" may be formed, for example, by molding a unitary piece. However, the present application is not limited in this regard. In some embodiments, the guidance member may be separately formed and mounted to a printed circuit board adjacent to the member. Additionally or alternatively, the guidance member may be unitarily molded with the frame. The connector may be mated with the complementary connector by moving at least one of the connectors relative to the other connector. The designs of the guidance members may polarize the connectors such that the guidance member may fit in a complementary guidance member by moving the connectors in one certain way. In the illustrated embodiment, the guidance member has a cross-shaped opening. However, the guidance member may have any suitable shapes, such as an asterisk, and may be a projection or any suitable structures.

Figure 2A:
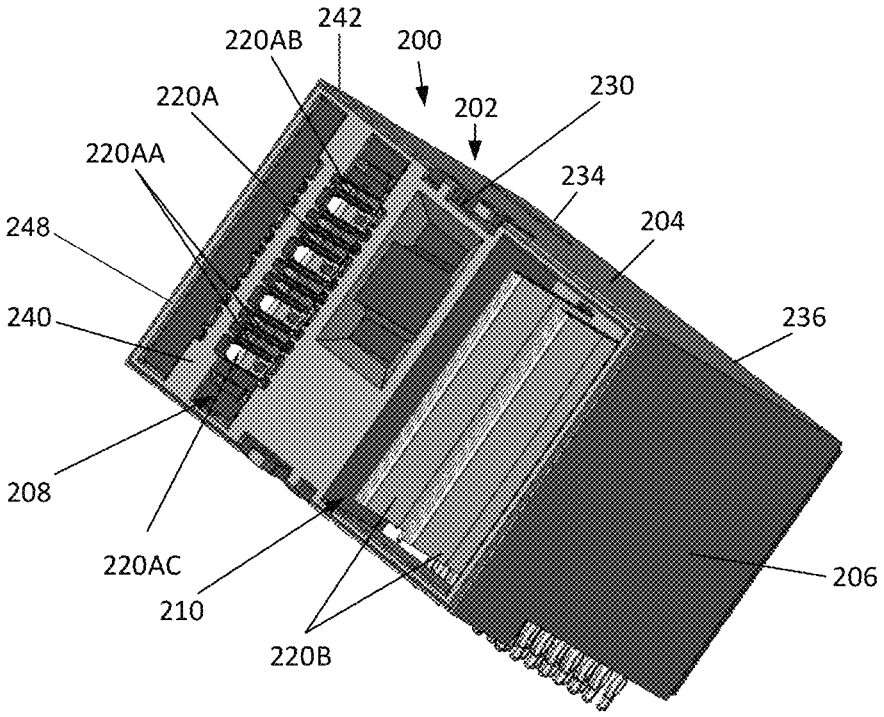
FIG. 2A is a perspective view of a connector, according to some embodiments.

FIG. 2A illustrates a connector 200, according to some embodiments. The connector may include a housing 202 and a plurality of conductive elements held by the housing. The plurality of conductive elements may include signal conductive elements 220A and power conductive elements 220B. The signal conductive elements may include conductive elements dedicated for distributing differential signals 220AA, single signal 220AB, and reference 220AC.

Housing 202 may include a member 204 having a plurality of sides 206 and an opening 208 at a first side 210. The opening may be bounded by a plurality of chamfered walls 248. Member 204 may further include a first section 234 and a second section 236. The first section may be dedicated to hold signal conductive elements while the second section may be dedicated to hold power conductive elements. The signal conductive elements may be held by leadframes 240. Leadframe 240 may be separately manufactured and then inserted into member 204. For simplicity of illustration, one leadframe is shown; however, the number of leadframes and corresponding signal conductive elements held by the leadframes may be plural depending on requirements of specific applications.

Figure 2B:
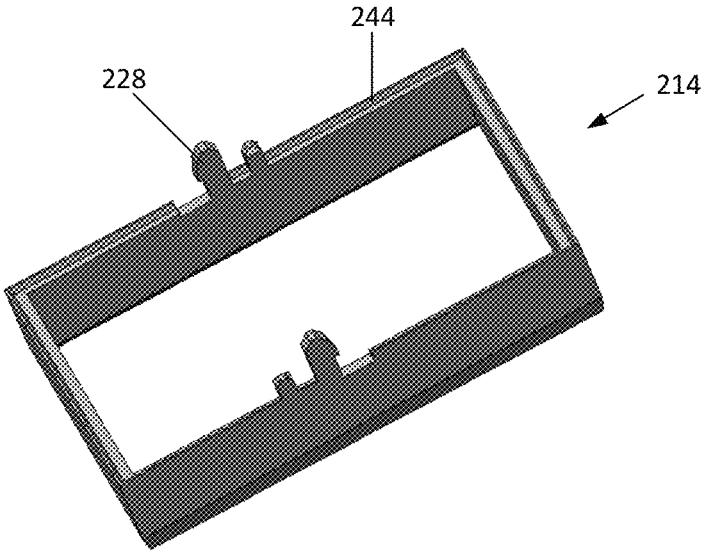
FIG. 2B is a perspective view of a frame to be mounted to the connector in FIG. 2A.

FIG. 2B illustrates a frame 214 that may be mounted to the housing member of connector 200 from the first side 210. The edges 244 of the frame may be beveled. The frame may include latches 228A and protrusions 228B to mate with matching latch receivers 230 on member 204. Latch 228A may be shaped to enter opening 242 and protrusion 228B may be shaped to fit within opening 246. The opening 242 may include a complimentary latch 240A.

To manufacture a connector 200, the frame 214 may be mounted to the member 204 from the first side 210 so as to bound the opening 208. Mounting the frame to the member may include moving the frame with respect to the member in a first direction perpendicular to the first side 210 to engage the latch 228A with the latch 240A, engaging edges 244 of the frame and the member so as to move the frame with respect to the member in a direction parallel to the first side, and further moving the frame with respect to the member in the first direction to engage protrusion 228B in opening 246 such that motion of the frame with respect to the member in the direction parallel to the first side is blocked. In some embodiments, the mounting may include engaging lip 229 on the frame with the latch 240A such that the latch 240A is locked in engagement with the latch 228A. In some embodiments, engaging edges 244 of the frame and the member so as to move the frame with respect to the member in a direction parallel to the first side may include sliding the beveled edges 244 into engagement with chamfers of the chamfered walls 248.

Figure 3:
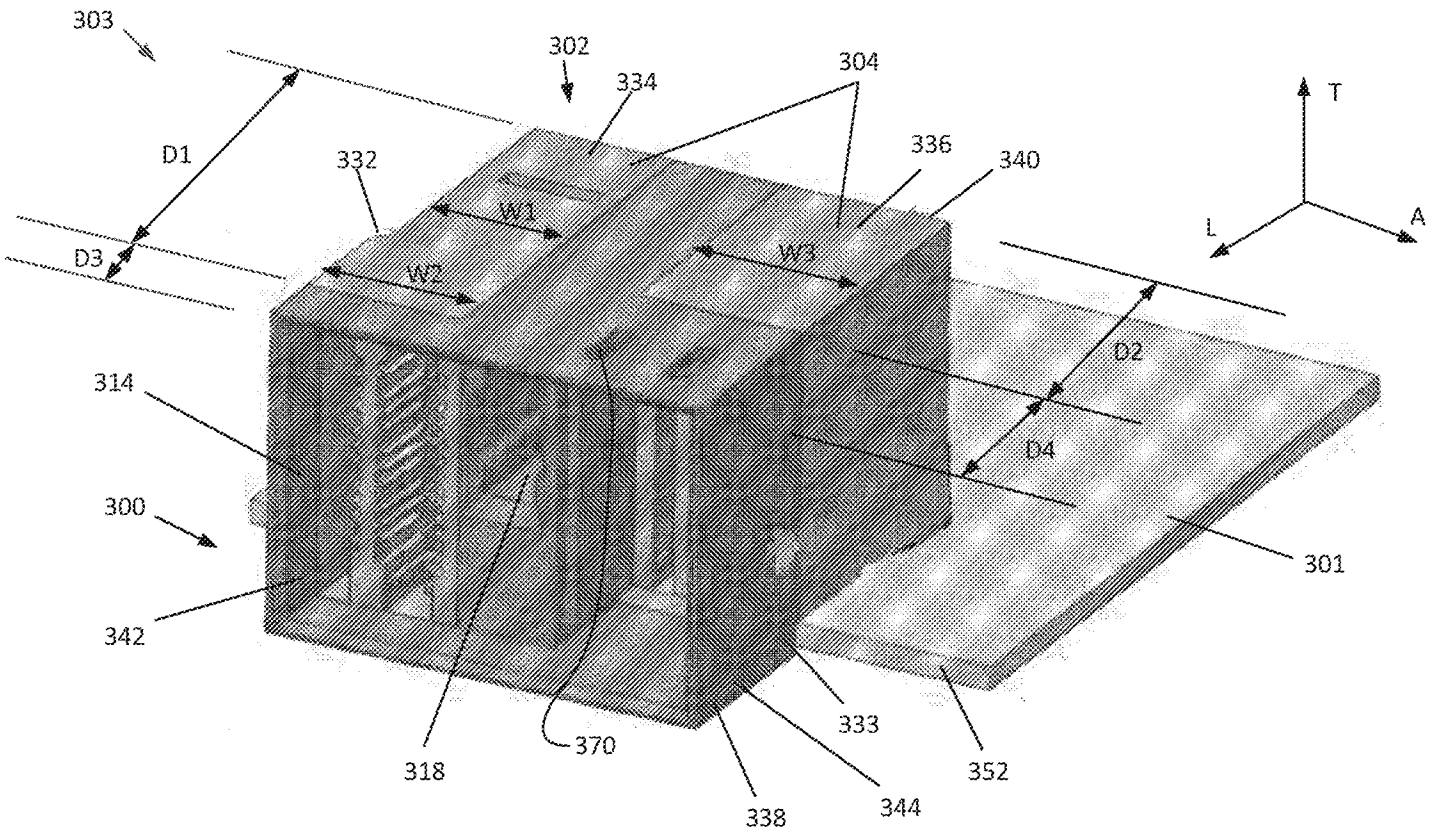
FIG. 3 is a perspective view of an electronic system, according to some embodiments.

FIG. 3 shows a perspective of an electrical system 303 including a connector 300 mounted to a printed circuit board 301, according to some embodiments. The connector may include a connector housing 302 to hold a plurality of conductive elements (not shown). The connector housing may include a member 304 and a frame 314.

The member 304 may include a first section 334 and a second section 336. The first section may be dedicated to hold signal conductive elements; the second section may be dedicated to hold power conductive elements. The first section may have a width of W1 between a first transition region 332 and a rear end 340, and a width of W2 between the first transition region and a front end 338 along a lateral direction. Different dimensions for W1 and W2 may enable, for example, the mating interface of connector 300 to be sized to receive a mating connector, while enabling the first section to elsewhere have a smaller size.

The second section may have the same width W3 along the lateral direction across a longitudinal direction perpendicular to the lateral direction. In some embodiment, W3 may equal to W2. The different widths may allow the volumes of the first and second sections to be set at the rear end according to different numbers and sizes of the conductive elements held and at the front end to ensure appropriate mating and/or unmating.

The sections of connector 300 may differ in other respects. For example, the first section 334 may have a depth of D1 along the longitudinal direction. The second section 336 may have a depth of D2 along the longitudinal direction. D2 may be smaller than D1. Nonetheless, the mating ends of the power conductive elements may be longer than the mating ends of the signal conductive elements to enable hot mating. When mounted to the printed circuit board, a front edge of the second section may be aligned with an edge 352 of the printed circuit board. When mounted to the printed circuit board, the first section may have a second transition region 333 extending beyond the edge of the printed circuit board and in a transverse direction perpendicular to the lateral and longitudinal directions to abut the edge of the printed circuit board. This design adds robustness to the mating and/or unmating process in that the edge of the printed circuit may provide reaction forces during mating and/or unmating, which reduces or illuminates disturbances to the mounting connection between the connector and the printed circuit board.

Connector 300 may include a guidance member 318 configured to engage a complementary guidance member of a complementary connector so as to align the connector with the complementary connector. The guidance member may be positioned between first section 334 and second section 336 such that the mating and/or unmating force may be substantially evenly distributed on both sections. The connector may be mated with the complementary connector by moving at least one of the connectors relative to the other connector. The designs of the guidance members may polarize the connectors such that the guidance member may fit in a complementary guidance member by moving the connectors in one certain way. In the illustrated embodiment, the guidance member has a cross-shaped opening. However, the guidance member may have any suitable shapes, such as half round or circular with a cutout notch, or any other suitable shape.

The frame 314 may include a first portion 342 and a second portion 344. The frame and the guidance member 318 may be a single-piece. A "single-piece" may be created by unitarily molding the structure. In the embodiment illustrated, the single-piece frame may be T-shaped, as in the example of FIG. 3. The guidance member may extend in the longitudinal direction (L). The first portion 342 may extend from the guidance member in a direction parallel to the lateral axis (A). The first portion may have a depth of D3 along the longitudinal direction. The second portion may extend from the guidance member in a direction parallel to the lateral axis (A). The second portion may have a depth of D4 along the longitudinal direction. D3 may be smaller than D4. The difference between D3 and D4 may equal to the difference between D2 and D1. As a result, the first portion may be mounted to the first section 334 while the second portion may be mounted to the second section 336 such that the connector has the same depths on the first and second portion sides.

Frame 314 may include any suitable features that facilitate operation of connector 300. As an example, frame 314 may include holes 370 there through. Holes 370 may be positioned above power conductive elements and may facilitate dissipation of heat. In some embodiments, holes 370 may be aligned with the mating interfaces of the power conductive elements mounted in second section 336.

FIGS. 4A-4D shows installation steps of the connector in FIG. 3, according to some embodiments. In the embodiment illustrated, the first section and second section of the member forming the housing of connector 300 are made as separate pieces. The installation steps may include 4A) mounting the first section 334 to the printed circuit board 301; 4B) mounting the second section 336 to the printed circuit board; 4C) mounting the frame 314 to the first section and the second section; and 4D) inserting screws into openings 450 to secure the frame. It should be appreciated that installing the connector may not require all above mentioned steps and/or in the described installation order. For example, the connector may be installed by mounting the frame to the first and second sections before being mounted to a printed circuit board.

Figure 4A:
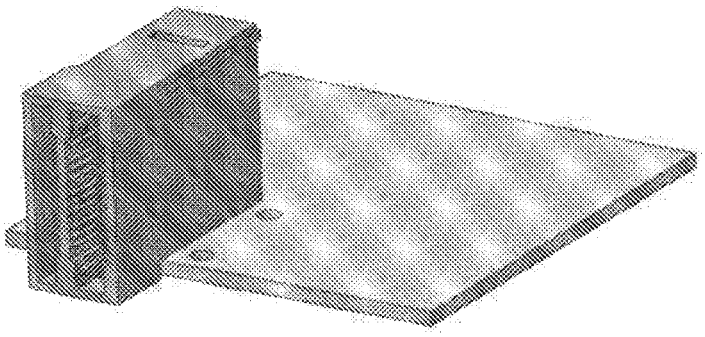
FIGS. 4A-4D shows installation steps of the connector in FIG. 3, according to some embodiments.
Figure 4B:
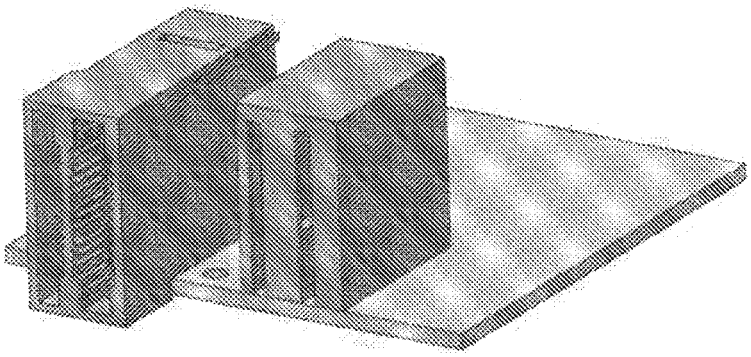
Figure 4C:
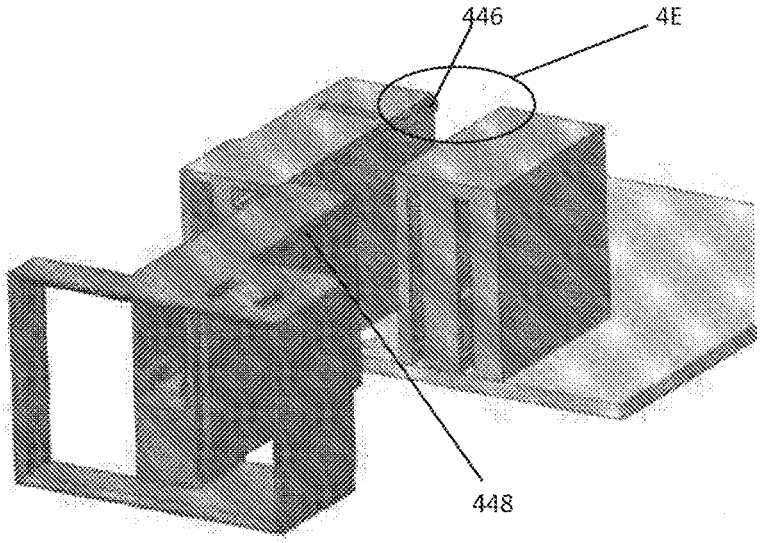
Figure 4D:
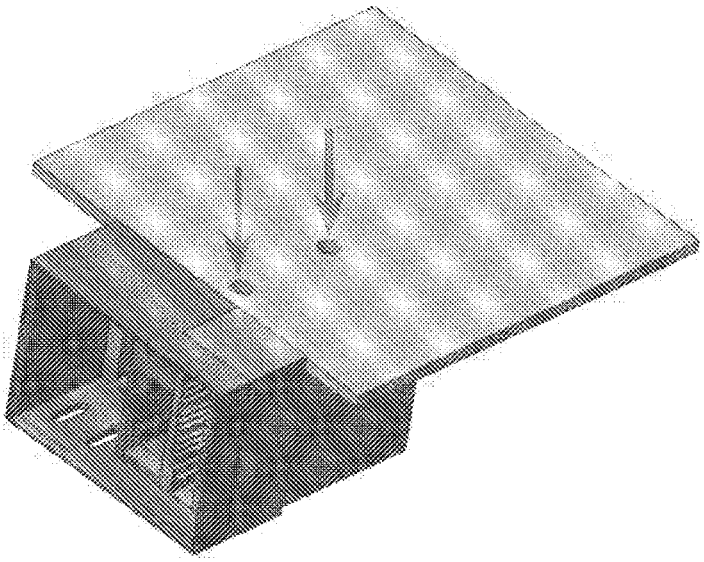
Figure 4E:
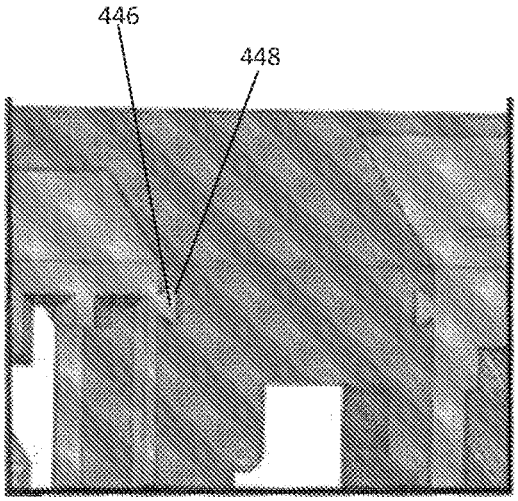
FIG. 4E is an elevation view of the circled region marked by 4E in FIG. 4C.

FIG. 4E illustrates an elevation view of the circled region marked by 4E in FIG. 4C. In some embodiments, the first and/or second sections may have dovetail-shaped ribs 446 while the frame may have corresponding slots 448 to receive the ribs. The ribs may function as guides when mounting the frame to the sections, and may make the connector more robust and avoid housing deforming during mating and/or unmating with a complementary connector.

Figure 5:
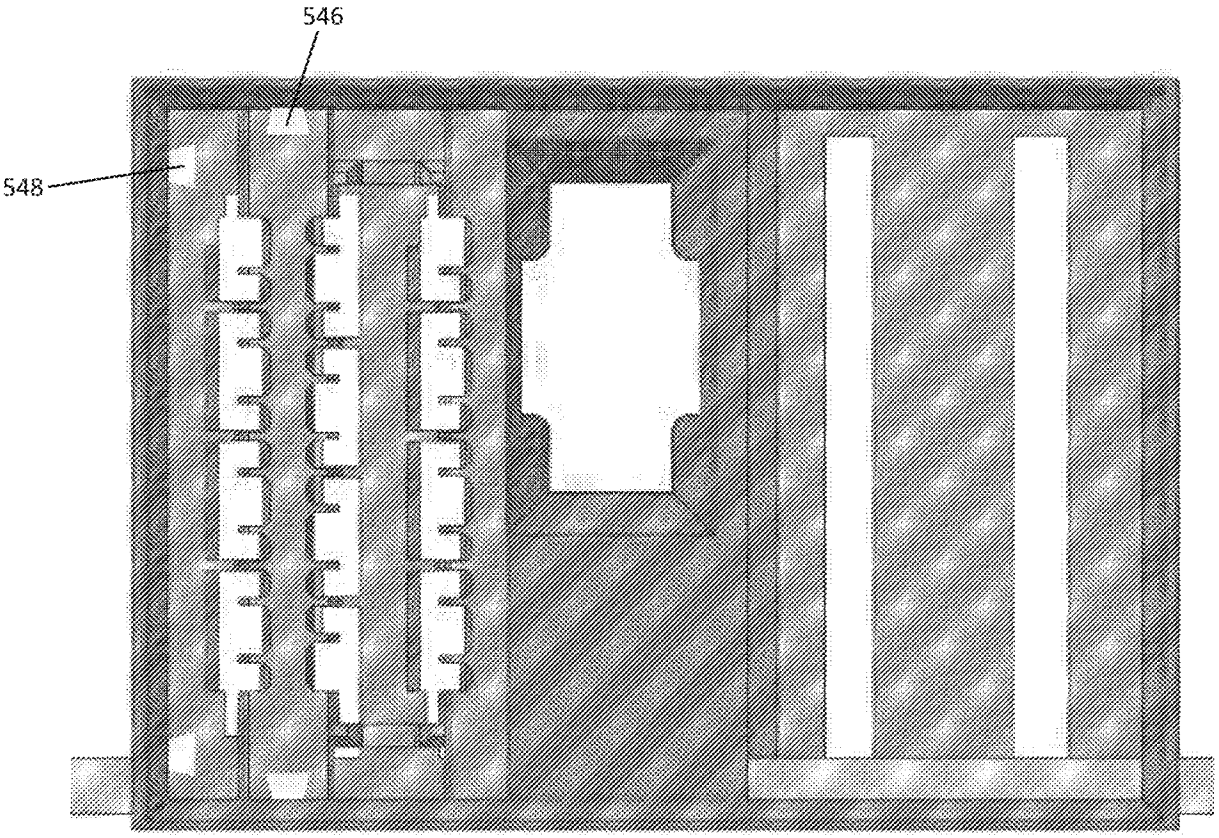
FIG. 5 is an elevation view of a connector, according to some embodiments.

FIG. 5 illustrates an elevation view of a connector, according to some embodiments. The signal side of the connector may include extra dovetail features 546, 548 so as to add additional strength. It should be appreciated that the additional dovetail features may not be limited to the signal side and may be applied to enhance the robustness of the housing at any suitable locations.

Figure 6:
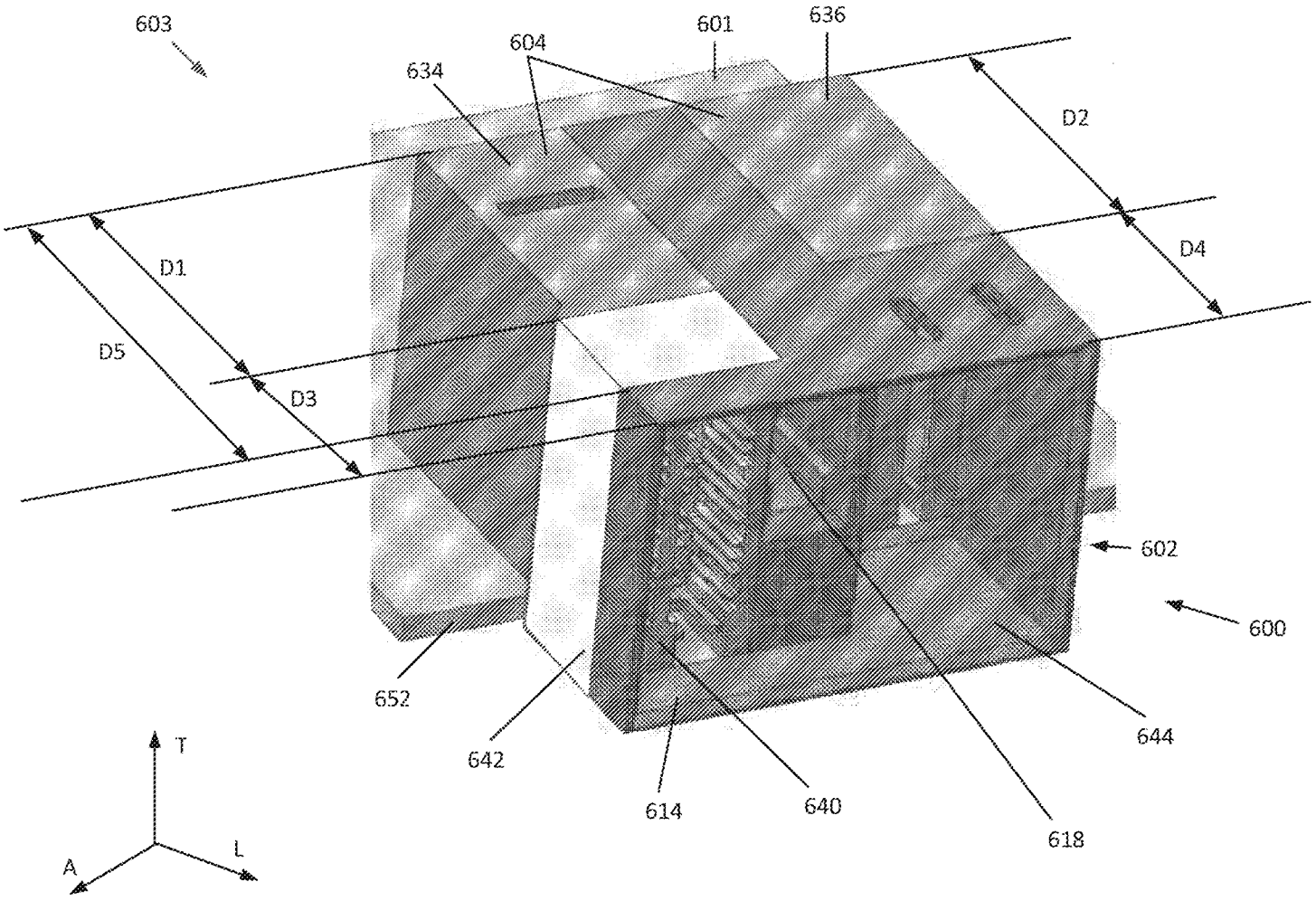
FIG. 6 is a perspective view of an electronic system, according to some embodiments.

FIG. 6 is a perspective view of an electrical system 603 including a connector 600 mounted to a printed circuit board 601, according to some embodiments. The connector may have a connector housing 602 including a member 604 and a frame 614.

The member 604 may include a first section 634 and a second section 636. The first section may be dedicated to hold signal conductive elements; the second section may be dedicated to hold power conductive elements. The first section 634 may have a depth of D1 along a longitudinal direction. The second section 636 may have a depth of D2 along the longitudinal direction. D2 may be designed such that enough of mating ends of power conductive elements are exposed for hot mating. D1 may be designed to equal to D2. When mounted to the printed circuit board, front edges of the first and second section may be aligned with an edge 652 of the printed circuit board.

The T-shaped frame 614 may include a first portion 642, a second portion 644, and a third portion 618. The third portion may be configured as a guidance member extending in the longitudinal direction. The first portion may extend from the guidance member along the lateral direction. The first portion may have a depth of D3 along the longitudinal direction. The second portion may extend from the guidance member along a direction opposite the lateral direction. The second portion may have a depth of D4 along the longitudinal direction. D3 may equal to D4. As a result, the first portion may be mounted to the first section 634 while the second portion may be mounted to the second section 636 such that the connector has the same depths on the first and second portion sides. The difference between FIG. 6 and FIG. 3 is that D3 of the first portion 642 equals to D4 of the second portion 644 while D3 of the first portion 342 is smaller than D4 of the second portion 344. It should be appreciated that the increased depth on the signal side of the frame may provide additional strength to the connector.

The frame 614 may extend beyond the edge of the printed circuit board in a transverse direction perpendicular to the lateral and longitudinal directions to abut the edge of the printed circuit board. This design adds robustness to the mating and/or unmating process in that the edge of the printed circuit may provide reaction forces during mating and/or unmating, which reduce disturbances to the mounting of the connector to the printed circuit board.

The connector may have leadframes 640 to hold signal conductive elements. The leadframes may extend along the longitudinal direction by a depth of D5. D5 may be larger than D1 but smaller than the sum of D1 and D3 such that the mating ends of the power conductive elements may be longer than the mating ends of the signal conductive elements to enable hot mating.

Although details of specific configurations of conductive elements, housing members, and frames are described above, it should be appreciated that such details are provided solely for purposes of illustration, as the concepts disclosed herein are capable of other manners of implementation. In that respect, various connector designs described herein may be used in any suitable combination, as aspects of the present disclosure are not limited to the particular combinations shown in the drawings.

For example, a connector for use with printed circuit board connectors was used to illustrate the construction techniques described herein. The same techniques may be used with a connector, also mounted to a printed circuit board, that mates with a connector that is part of a cable assembly. In yet further embodiments, neither a connector with a frame and a housing member as described herein nor a mating connector may be mounted to a printed circuit board.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, a frame was described in connection with a connector mounted to a complementary connector. A frame may be used in connection with any suitable component mounted to any suitable devices. As a specific example of a possible variation, a frame may be used with a connector mounted to a printed circuit board.

Furthermore, although many inventive aspects are shown and described with reference to a connector having a right angle configuration, it should be appreciated that aspects of the present disclosure is not limited in this regard, as any of the inventive concepts, whether alone or in combination with one or more other inventive concepts, may be used in other types of electrical connectors, such as mezzanine connectors, cable connectors, stacking connectors, I/O connectors, chip sockets, etc.

The present disclosure is not limited to the details of construction or the arrangements of components set forth in the foregoing description and/or the drawings. Various embodiments are provided solely for purposes of illustration, and the concepts described herein are capable of being practiced or carried out in other ways. Also, the phraseology and terminology used herein are for the purpose of description and should not be regarded as limiting. The use of "including," "comprising," "having," "containing," or "involving," and variations thereof herein, is meant to encompass the items listed thereafter (or equivalents thereof) and/or as additional items.

What is claimed is:

1. A connector comprising:

a housing comprising:

a member having a plurality of sides and a first opening at a first side, the first opening comprising a first section and a second section separated by a portion of the member, and a frame mounted to the member at the first side and having a plurality of walls bounding the frame and defining a second opening, wherein the second opening is aligned with the first opening and the plurality of walls are aligned with a perimeter of the first opening; and a plurality of conductive elements held by the housing, each of the plurality of conductive elements comprising a mating end, a mounting end opposite the mating end, and an intermediate portion that extends between the mating end and the mounting end, wherein:

the mating ends are exposed within the first opening.

2. The connector as recited in claim 1, wherein the frame comprises at least one rib with a dovetail-shaped cross-section; and the member comprises at least one slot sized and positioned to receive the at least one rib.

3. The connector as recited in claim 1, wherein the member is plastic.

4. The connector as recited in claim 3, wherein the plurality of sides of the member are formed by plastic walls not thicker than 1.0 mm.

5. The connector as recited in claim 1, wherein the frame is metal.

6. The connector as recited in claim 5, wherein the frame is die-cast metal.

7. The connector as recited in claim 1, wherein:

the frame comprises at least one latch; and the member comprises at least one opening configured to receive the latch.

8. The connector as recited in claim 7, wherein:

the first opening is bounded by a plurality of chamfered walls;

the plurality of walls of the frame are beveled walls; and the plurality of chamfered walls mate with the plurality of beveled walls.

9. The connector as recited in claim 1, wherein the plurality of conductive elements comprise signal conductors and power conductors.

10. The connector as recited in claim 9, wherein the signal conductors comprise at least one pair of differential signal contacts and at least one single signal contact.

11. The connector as recited in claim 9, wherein the first section holds the signal conductors, and the second section holds power conductors.

12. The connector as recited in claim 11, wherein:

the connector further comprises a guidance member positioned between the first section and the second section, and the guidance member is configured to engage a complementary guidance member of a complementary connector so as to align the connector with the complementary connector.

13. The connector as recited in claim 12, wherein the guidance member and the member is a single-piece.

14. A connector comprising:

a housing comprising:

a member having a plurality of sides and a first opening at a first side, the first opening comprising a first section and a second section separated by a portion of the member, and a frame mounted to the member at the first side and having a plurality of walls defining a second opening, wherein the second opening is aligned with the first opening; and a plurality of conductive elements held by the housing, each of the plurality of conductive elements comprising a mating end, a mounting end opposite the mating end, and an intermediate portion that extends between the mating end and the mounting end, wherein:

the mating ends are exposed within the first opening, and the first section of the member has a depth greater than a depth of the second section of the member along a longitudinal direction substantially perpendicular to the first side.

15. The connector as recited in claim 14, wherein:

the connector further comprises a guidance member positioned between the first section and the second section, the guidance member is configured to engage a complementary guidance member of a complementary connector so as to align the connector with the complementary connector, and the guidance member and the frame is a single-piece.

16. The connector as recited in claim 14, wherein:

the frame has a first portion and a second portion, the first portion of the frame is mounted to the first section of the member of the housing, and the second portion of the frame is mounted to the second section of the member of the housing.

17. The connector as recited in claim 16, wherein a depth of the first portion of the frame is less than a depth of the second portion of the frame along the longitudinal direction.

18. An electronic assembly comprising:

a first printed circuit board; and a first connector mounted to the first printed circuit board, the first connector comprising:

a housing comprising:

a member having a plurality of sides and at least one opening at a first side, the at least one opening being bounded by a perimeter; and a frame comprising a plurality of walls, wherein:

the frame is mounted to the member with the plurality of walls of the frame aligned with the perimeter of the at least one opening, and the plurality of walls comprise features interlocking with features of the member at the perimeter of the at least one opening; and a plurality of conductive elements held by the housing, each of the plurality of conductive elements comprising a mating end, a mounting end opposite the mating end, and an intermediate portion that extends between the mating end and the mounting end;

wherein the mounting ends of the plurality of conductive elements are electrically connected to the first printed circuit board and the mating ends of the plurality of conductive elements are exposed within openings of the at least one opening.

19. The electronic assembly as recited in claim 18, wherein the member is insulative and the frame is metal.

20. The electronic assembly as recited in claim 18, further comprising:

a second printed circuit board; and a second connector mounted to the second printed circuit board, the second connector extending through the perimeter of the at least one opening to form electrical connections with the mating ends of the plurality of conductive elements exposed within the openings of the at least one opening.

21. The electronic assembly as recited in claim 18, wherein:

the frame comprises a latch and a protrusion; and the member comprises a latch receiver, the latch receiver comprising:

a first opening;

a complementary latch disposed within the first opening;

a second opening; and a wall separating the first opening from the second opening, wherein the features of the frame interlocking with features of the member comprise:

the latch extending into the first opening and engaging the complementary latch, and the protrusion fitting within the second opening.

22. The electronic assembly as recited in claim 21, wherein the at least one opening of the member of the housing is bounded by a plurality of chamfered walls;

the frame comprises a plurality of beveled walls; and the features of the frame interlocking with features of the member further comprise the plurality of chamfered walls interlocking with the plurality of beveled walls.

23. A method of manufacturing a connector comprising a housing comprising a member having a plurality of sides and an opening at a first side, the method comprising:

mounting a frame having a plurality of walls to the member from the first side so as to bound the opening, the mounting comprising:

moving the frame with respect to the member in a first direction to engage a latch on the frame with a complementary latch on the member, the first direction being perpendicular to the first side;

engaging edges of the frame and the member so as to move the frame with respect to the member in a direction parallel to the first side; and further moving the frame with respect to the member in the first direction to engage a projection in an opening whereby motion of the frame with respect to the member in the direction parallel to the first side is blocked.

24. The method of claim 23, wherein mounting further comprises engaging a lip on the frame with the complementary latch, such that the complementary latch is locked in engagement with the latch.

25. The method of claim 23, wherein:

the opening is bounded by chamfered walls;

the edges of the frame are beveled; and engaging edges of the frame and the member so as to move the frame with respect to the member in a direction parallel to the first side comprises sliding the beveled edges of the frame into engagement with chamfers of the chamfered walls of the member.

* * * * *